United States Patent [19]

Lepage et al.

[11] 4,233,705

[45] Nov. 18, 1980

[54] PAINT METERING TRAY FOR ROLLER APPLICATIONS

[76] Inventors: Michel Lepage; Jeanne L. Lepage, both of General Delivery, Capreol, Ontario, Canada, POM 1HO

[21] Appl. No.: 52,554

[22] Filed: Jun. 27, 1979

[51] Int. Cl.[3] ..... B44D 3/12

[52] U.S. Cl. ..... 15/257.06; 15/104.92; 118/258

[58] Field of Search ..... 15/257.06, 257.05, 103.5, 15/104.92; 401/118; 101/331; 118/258

[56] References Cited

U.S. PATENT DOCUMENTS

| | | | |
|---|---|---|---|
| 3,079,625 | 3/1963 | Rasmussen | 15/257.06 |
| 3,128,494 | 4/1964 | Hohmann | 15/103.5 |
| 3,135,000 | 6/1964 | Rasmussen | 15/257.06 X |
| 3,648,322 | 3/1972 | Meisner | 15/104.92 X |
| 4,106,434 | 8/1978 | Vines | 15/257.05 |
| 4,107,815 | 8/1978 | Dumesnil, Jr. | 15/257.05 |
| 4,164,803 | 8/1979 | Zurawin | 15/257.05 |

*Primary Examiner*—Edward L. Roberts
*Attorney, Agent, or Firm*—George H. Riches

[57] ABSTRACT

A paint metering tray for use with conventional paint applicator rollers. The tray has a paint distribution roller spanning the width thereof, the bottom portion of which will be immersed in the paint in the tray. A paint metering bar is engaged against the length of the distribution roller to remove excess paint therefrom as the distribution roller is axially rotated. The paint is evenly and consistently applied to the applicator roller from the even distribution on the distribution roller surface.

5 Claims, 2 Drawing Figures

40
38
18
2
12
22
36
24
28
20
10
16
26
2
14

34
32

38
28
18
30

PAINT METERING TRAY FOR ROLLER APPLICATIONS

BACKGROUND OF THE INVENTION

This invention relates to paint trays for use with paint roller applicators and particularly to a new paint tray for supplying an even and regulated amount of paint onto the paint roller applicator.

In the use of roller applicators with paint trays, distribution of the paint onto the roller applicator is accomplished by moving the roller back and forth in the paint on the inclined bottom portion of the tray. This method of coating the roller applicator has several drawbacks. A good deal of time and effort is spent in ensuring that the paint is sufficiently applied to the applicator without an excess amount of paint being so applied. There is a certain volume of paint which the painter prefers to use at any particular job and it is preferable if that amount can be consistently and regularly applied to the roller applicator.

When the roller applicator is dipped into the paint there is an additional problem in that the paint tends to collect at the ends of the roller, which leads to dripping when applying the paint.

SUMMARY OF THE INVENTION

Accordingly, it is an object of the present invention to provide a paint tray which can easily and consistently supply a fixed amount of paint to a conventional roller applicator.

In one embodiment of the invention there is provided a paint metering tray comprising a paint distribution roller positioned to be in contact along a lengthwise portion of the surface thereof with that volume of the tray designed to hold the paint, said distribution roller being axially rotatable so as to permit coverage of the surface of the distribution roller with paint when rotated, and a paint metering bar in lengthwise orientation along the surface of the distribution roller so as to control the amount of paint on the distribution roller as the distribution roller is rotated against the said bar.

In another embodiment there is provided a paint metering tray for use with conventional paint roller applicators, wherein the bottom of the tray is cross-sectionally concave, comprising a paint distribution roller axially rotatably supported in the sides of the tray slightly above the lowest point in the bottom of the tray, said distribution roller having means to axially rotate the distribution roller, and a paint metering bar moveably supported on the sides of the tray and engageable against the length of the distribution roller.

DESCRIPTION OF THE PREFERRED EMBODIMENTS

Referring to both Figures, a paint metering tray 10 is provided of either standard shape or, as shown, with a concave bottom 12. Supports 14 and 16 may be provided to support the tray if it has a concave bottom surface.

Figure 1:
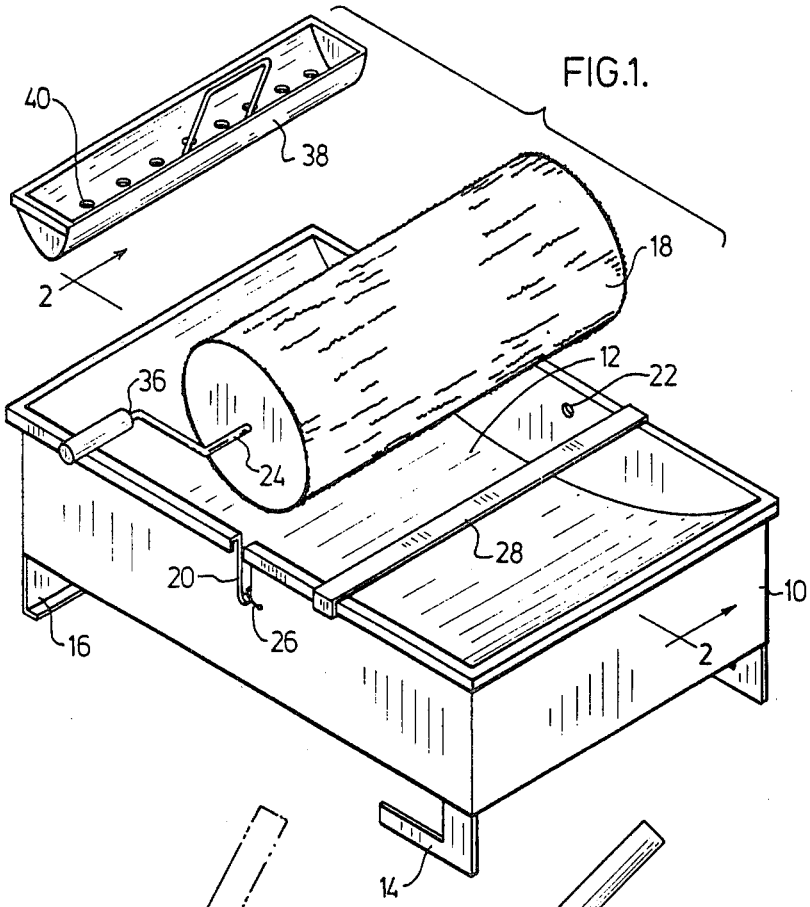
FIG. 1 is a perspective exploded view of a preferred embodiment of the invention.
Figure 2:
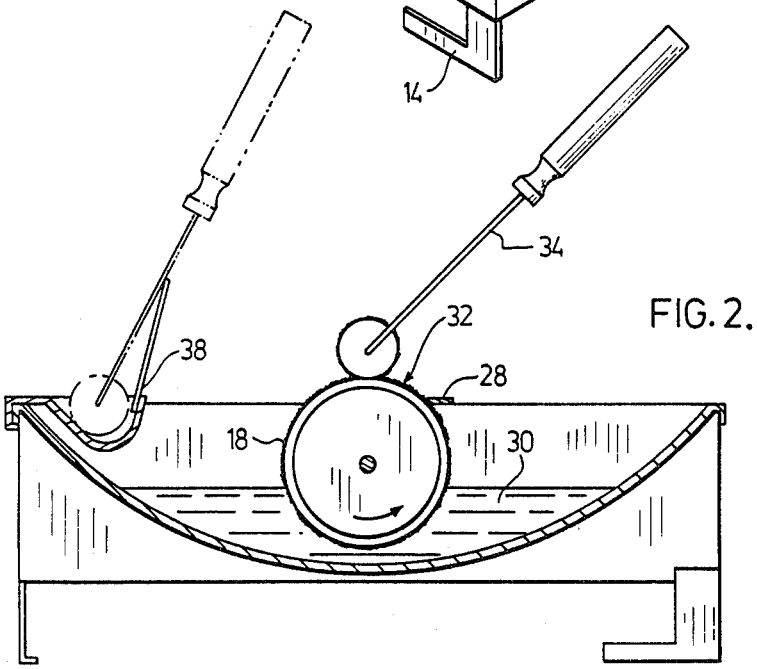
FIG. 2 is a cross-sectional view of the tray in FIG. 1 in use as seen across 2—2.

The paint distribution roller is indicated by reference numeral 18. It is located in the tray 10 so that the bottom portion thereof will be immersed in paint as shown in FIG. 2. The distribution roller 18 can be affixed in this position by any suitable means. Shown in the drawings is a slot 20 and a hole 22 into which an axial protrusion 24 can be inserted to hold the distribution roller 18 at the desired position. It is preferred if a retaining means of some type, such as spring 26, is used to removeably secure the distribution roller 18 in the slot 20. This structure allows for easy removal of the distribution roller 18 for cleaning.

A paint metering bar 28 is provided to control the amount of paint on the distribution roller 18. This bar 28 can be slidably attached on the side walls of tray 10. In operation, bar 28 is oriented against the length of the distribution roller 18. As the distribution roller 18 is axially rotated, as indicated by the arrow in FIG. 2, the surface thereof passes through the paint 30 in the tray 10 and then across the bar 28. In this manner, by choosing the distance between bar 28 and the paint covered surface of distribution roller 18, the amount of paint which will remain on the distribution roller 18 can be consistently and easily determined. By moving the bar 28 closer or further away from the surface of the distribution roller 18, the amount of paint on the surface of the distribution roller 18 in portion 32 can be decreased or increased, respectively, as required.

The amount of paint in section 32 on the surface of the distribution roller 18 can be controlled. Therefore, when the paint applicator roller 34 is placed against the distribution roller 18, as shown in FIG. 2, the amount of paint applied to the applicator roller 34 upon axially rotating distribution roller 18 can be controlled. A suitable means for rotating distribution roller 18 is crank 36.

A roller applicator receiving trough 38 can also be removeably attached on one end of the tray 10 to hold the roller applicator 34 when not in use. Openings 40 are provided to allow paint on the roller applicator 34 to drip back into tray 10 instead of collecting in the trough 38.

Although the description of this invention has been given with respect to a particular embodiment, it is not to be construed in a limiting sense. Many variations and modifications will now occur to those skilled in the art. For a definition of the invention reference is made to the appended claims.

What I claim is:

1. A paint metering tray for use with a paint roller applicator comprising:

(a) a paint distribution roller positioned to be in contact along a lenthwise portion of the surface thereof with paint in said tray, said distribution roller being axially rotatable so as to permit coverage of the surface of the distribution roller with the paint when rotated, and (b) a paint metering bar in lengthwise orientation along the surface of the distribution roller so as to control the amount of paint on the distribution roller as the distribution roller is rotated against the said bar wherein the paint metering bar is adjustably moveable into lengthwise contact along the surface of the distribution roller.

2. A paint tray as claimed in claim 1 further comprising means for axially rotating the distribution roller.

3. A paint metering tray with a cross-sectionally concave bottom for use with conventional paint rollers comprising:

(a) a paint distribution roller axially rotatably supported in the sides of the tray slightly above the lowest point in the bottom of the tray, said distribution roller having means to axially rotate the distribution roller, and (b) a paint metering bar moveably supported on the sides of the tray engageable against the length of the distribution roller.

4. A paint metering tray for a paint roller applicator comprising in combination: a paint distribution roller revolvably fitted between vertical side walls such that the periphery of said distribution roller is close to the bottom of the said tray; said paint distribution roller having a crank handle mounted in the center of one end and a short shaft mounted in the center of the opposite end; and an adjustable paint metering bar clip-mounted to the flanges of both sides of the said trady, so as to be adjusted in proximity to said paint distribution roller to meter paint from the said distribution roller onto said paint roller.

5. A paint metering tray as described in claim 4 in which the said paint distribution roller is revolvably fitted between side walls by the use of a short shaft in the center of one end of the said distribution roller which is fitted in the hole on one side of the said paint metering tray and a crank handle which is fitted in a slot on the opposite wall of the said tray and is retained in said slot by a spring.

* * * * *